United States Patent [19]

Meisner et al.

[11] Patent Number: 4,740,384

[45] Date of Patent: Apr. 26, 1988

[54] PROCESS AND APPARATUS FOR APPLYING TWO OR MORE COLORS OF PAINT

[75] Inventors: Roland A. Meisner, Senden; Hans Pollinger, Ingolstadt; Bernd Krüger, Grossmehring, all of Fed. Rep. of Germany

[73] Assignee: BASF Lacke & Farben AG, Münster-Hiltrup, Fed. Rep. of Germany

[21] Appl. No.: 82,934

[22] Filed: Aug. 5, 1987

Related U.S. Application Data

[63] Continuation of Ser. No. 701,253, May 29, 1985, abandoned.

[30] Foreign Application Priority Data

Oct. 12, 1983 [DE] Fed. Rep. of Germany ..... 3337028
Sep. 29, 1984 [DE] Fed. Rep. of Germany ..... 3435937

[51] Int. Cl.[4] ..... B05D 1/04

[52] U.S. Cl. ..... 427/14.1; 427/26; 427/30; 427/261; 118/624; 118/625; 118/626

[58] Field of Search ..... 427/26, 30, 14.1, 261; 118/624, 625, 628

[56] References Cited

U.S. PATENT DOCUMENTS

| | | | |
|---|---|---|---|
| 2,780,565 | 2/1957 | Juvinall | 118/625 |
| 3,054,697 | 9/1962 | Irland | 118/625 |
| 3,413,917 | 12/1968 | Fisher | 118/626 |
| 3,486,483 | 12/1969 | Tilney | 118/626 |
| 3,596,275 | 7/1971 | Sweet | 118/625 |
| 3,639,147 | 2/1972 | Benefiel | 427/389.7 |
| 3,714,928 | 2/1973 | Taylor | 118/624 |
| 4,551,491 | 11/1985 | Panush | 427/388.1 |

FOREIGN PATENT DOCUMENTS 723496 4/1983 German Democratic Rep. ... 427/28

OTHER PUBLICATIONS

Rudolf Kreisler, "Das elektrostatische Lackieren von Massenteilen," Part 1, *Schilde,* 1963, pp. 31–33.
Rudolf Kreisler, "Das elektrostatische Lackieren von Massenteilen," Part II, *Schilde,* 1963, pp. 37–41.
*Industrie-Lackier-Betrieb,* vol. 31, 1963, pp. 305–308.
Brochure of AEG Elektro-Pinsel, Oct. 1962.

*Primary Examiner*—Richard R. Bueker
*Attorney, Agent, or Firm*—Kenyon & Kenyon

[57] ABSTRACT

The invention relates to a process and an apparatus for applying two or more colors of paint by applying a first paint to at least part of a substrate, followed by a second and, if desired, further different-colored paints to different parts of the substrate and hardening the applied coats of paint by baking, which comprises applying the second and if desired the further different-colored paints without interim baking of the first paint to the preselected different parts of the substrate using electrostatic atomization at stationary atomizer edges involving transport of the paint particles in an electric field and, after the first and subsequent paints have been applied, hardening all coats of paint together by baking.

3 Claims, 2 Drawing Sheets

3
2
1
5
4

3
6
7
8
2
G
4

PROCESS AND APPARATUS FOR APPLYING TWO OR MORE COLORS OF PAINT

This application is a continuation of application Ser. No. 701,253, filed May 29, 1985, now abandoned.

BACKGROUND OF THE INVENTION

The invention relates to a process for applying two or more colors of paint to a surface of a substrate.

The invention also relates to an apparatus for implementing the process.

The conventional way of applying two or more colors of paint in such a way that the individual paints do not cover all of the substrate to be painted, so that the colors need to be sharply delimited from one another, comprises coating the substrate with a paint of a first color, drying and baking the coat of paint, and then covering up the area so painted, whereupon the uncovered areas are then painted with a second or further paints (see *Lehrbuch fur Fahrzeuglackierer* [*Teaching Manual for Vehicle Paint Shops*], published by Neuer Merkur GmbH, Munich, 1st edition, 1981, page 190). This procedure is time- and energy-consuming owing to the need for drying and baking between the application of any two paints. Moreover, a great deal of paint is wasted in the region of overlap.

It is the object of the invention to provide a process and an apparatus for applying a multicolored coating in which all different-colored painted areas are relatively sharply delimited from one another and thus meet the demands on a decorative surface, without a need for interim drying or baking, and in which, furthermore, the region of overlap at the boundaries between the individual colors can be kept to minimum.

SUMMARY OF THE INVENTION

In a process in accordance with the invention, a substrate is coated with the first paint or color in an electrostatic field in a manner known per se, for example by spraying with the aid of pneumatic atomizers or centrifugal atomizers. Without first drying or baking this first coat of paint, the generally differently colored second or any subsequent generally differently colored paint is applied by an atomizer which works with electrostatic transport of the paint particles and which, at the boundaries between the colors, embosses the paint droplets with a pulse which is virtually parallel to the normal to the substrate surface at the point of application. The atomizer proposed by the invention is an appliance which works electrostatically with stationary atomizer edges and transport of the paint particles in an electric field.

The use of electrostatic atomization on stationary atomizer edges with transport of the paint particles in an electric field has been known for a long time, as can be seen from the publication *Industrielackierbetrieb*, Volume 25, No. 2, 1957, pages 34 and 35. According to reference, the spray pattern obtained is a shape between a rectangle and an oval without a sharp edge.

Pursuant to particular features of the process according to the invention, the spray pattern can be controlled by the use of an auxiliary electrode, preferably movable relative to the atomizer edges and more preferably movable in a direction parallel thereto.

Pursuant to another particular feature of the process according to the invention, the spray pattern can even be changed in the course of spraying itself by moving the auxiliary electrode.

In an apparatus for implementing the process according to the invention, an essential feature is that a longitudinal axis of a spray gap formed by the atomizer edges is essentially perpendicular to a normal to the surface of the substrate, so that the longitudinal axis of the gap is parallel to the substrate.

It is particularly advantageous when the spray gap is aligned in such a way that it is essentially perpendicular to a plane formed by a normal to a substrate surface at the boundaries between the colors and by a direction of motion of the substrate. The effect of this unusual arrangement of the spray-dispensing element is that, at the boundaries between the colors, the paint droplets are electrostatically marked with a pulse which afterwards is parallel to the normal on the surface at that point, thereby producing the sharp delimitation of the applied paint at the color boundary.

In a further advantageous embodiment of the apparatus according to the invention, one or more auxiliary electrodes which are adjustable, preferably automatically adjustable, and which limit the effective length of the spray gap are provided parallel to the longitudinal axis of the spray gap and in front of the spray gap. By means of these auxiliary electrodes it is possible to regulate the width of a strip of paint and, by moving these auxiliary electrodes up and down during the paint application process, to introduce in a very simple manner contours in the strip of paint or to achieve adaptation to the shape of the surface of the substrate without the need for further aids.

The invention is especially suitable for applying two paints of different color to automotive body shells. According to the invention, both colors can be applied wet on wet. The narrow boundary region, which is obtainable by means of the process according to the invention, between different-colored areas can be covered up with components such as rubbing strips. The invention renders superfluous the intermediate step hitherto necessary in paint application, namely, baking the first coat of paint before the second color is applied. The advantages are shorter cycle times and lower energy consumption per painted body shell. The space requirements are also lower.

BRIEF DESCRIPTION OF THE DRAWING

FIG. 3 is a diagrammatic perspective view of the arrangement according to the invention.

DETAILED DESCRIPTION

Figure 1:
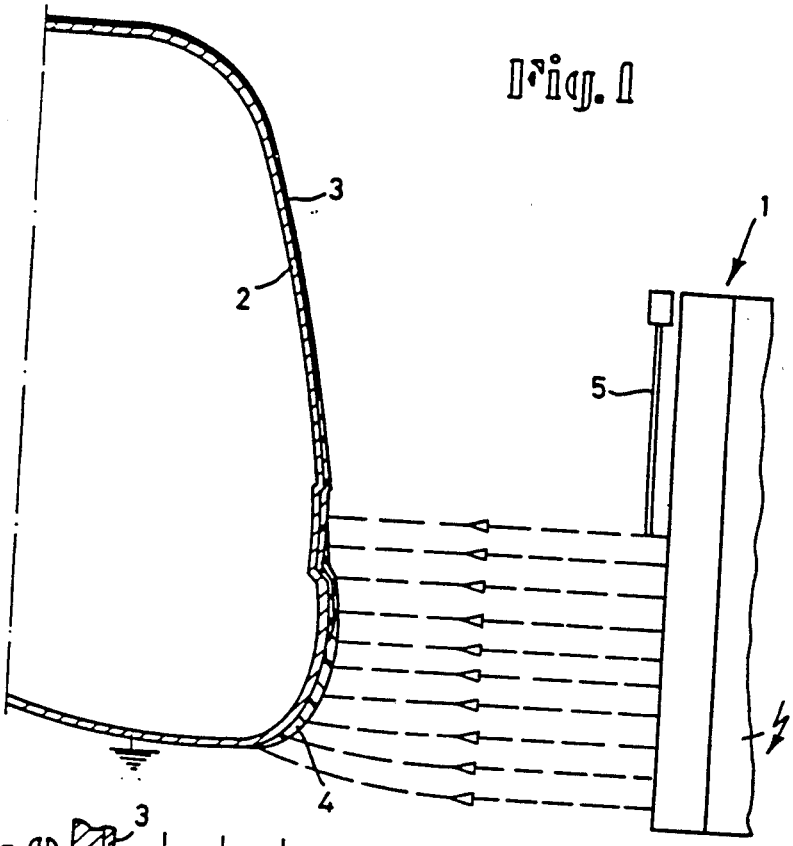
FIG. 1 is a schematic view of a spray-dispensing element in accordance with the invention, together with a substrate in the appropriate position.

As shown in FIG. 1, a spray-dispensing element 1 which is under high voltage permits electrostatic atomization of supplied liquid paint at stationary atomizer edges which define a spray gap 9 (FIG. 3). A substrate 2, for example an automotive body shell, is connected to ground and has been coated with a first coat of paint 3. A second coat of paint 4 is applied with the spray-dispensing element 1 and preferably has a different color.

Mechanically adjustable auxiliary electrodes 5 may be arranged in front of the spray gap 9; they can be adjustable, for example, in the direction of the longitudinal axis x-x of the gap for restricting the effective length of the spray gap 9.

In FIG. 3, the boundaries between different colors are schematically indicated at 10, and while reference numeral 11 denotes the normal to the surface at the color boundaries.

The first coat of paint 3 can be applied by conventional methods for applying coats of paints to substrates. There is no need for a sharp delimitation of the first coat of paint 3 from the coat of paint 4 to be applied subsequently; nor can such a delimitation be achieved with the currently customary procedures. It can be seen, in particular from FIG. 1, that the transition region of the first coat of paint 3 can extend into the area to be coated with the second coat of paint 4.

Figure 2:
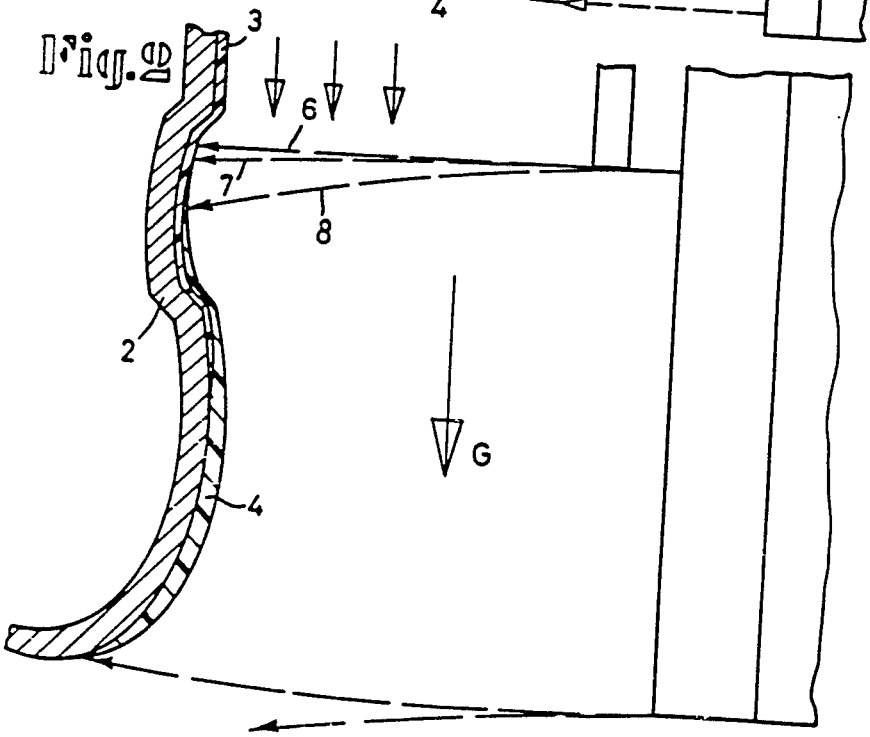
FIG. 2 shows on a larger scale the relationship between the spray-dispensing element and the substrate to clarify the lines of action.
Figure 5:
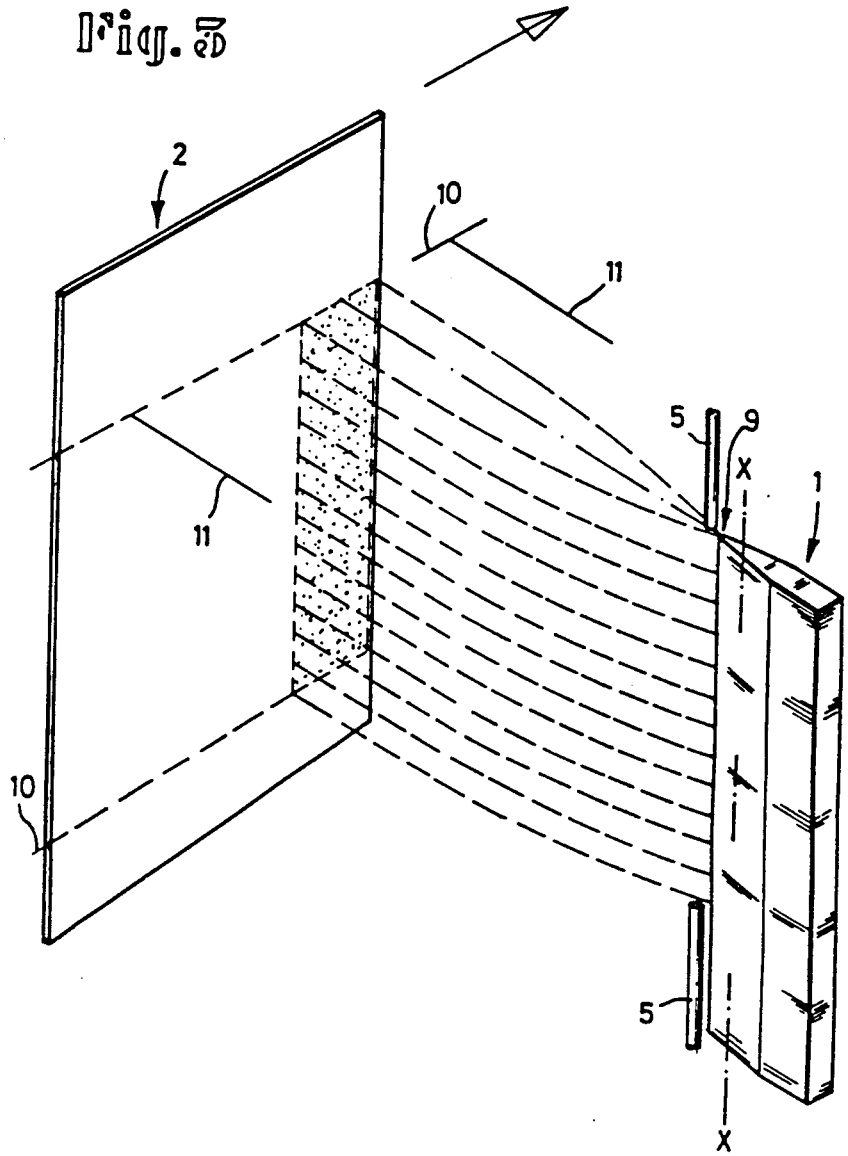

FIG. 2 shows the flightpaths of paint droplets under the influence of air resistance and the force of gravity G. Relatively small and hence relatively lightweight paint droplets travel toward the substrate along flightpath 6, while heavier, i.e. bigger, paint droplets travel from the spray-dispensing element 1 to the substrate 2 by way of flightpaths 7 and 8. This dependence of the flightpaths upon droplet size has the effect that a transition region is produced for the second coat of paint as well. However, since this region is less than 2 cm wide the two coats of paint 3 and 4 are sufficiently well separated. The transition region, which, as already started, is only 2 cm wide, can be covered with appropriate decorative strips or the like.

It can be seen from FIG. 3 that, in order to obtain the crisp color boundaries 10, the longitudinal axis x—x of the spray gap 9 must be aligned in such a way that this longitudinal axis is perpendicular to the plane defined by the normal 11 to the substrate surface at the color boundaries.

What is claimed is:

1. A method of applying a plurality of differently colored paints to a surface of a substrate, comprising the steps of:

applying a coat of a first paint to a first surface portion of the substrate, said first paint having a first color;

electrostatically atomizing at a stationary atomizer edge, by means of an electric field generated by a pair of electrodes, a second paint having a second color discernably different from said first color;

electrostatically transporting the atomized particles of said second paint from said atomizer edge to at least one second surface portion of said substrate, thereby forming a coat of said second paint on said second surface portion, said second surface portion including an area of the surface of said substrate different from all areas included in said first surface portion;

baking the coats of paint on said first surface portion and said second surface portion of said substrate to harden the coats of paint, said step of baking being performed only upon execution of said steps of applying, electrostatically atomizing and electrostatically transporting;

utilizing at least one auxiliary electrode to control spreading of the atomized particles in a direction substantially transverse to direction of transport of said atomized particles from said stationary atomizer edge to said second surface portion; and moving said auxiliary electrode during said steps of electrostatically atomizing and electrostatically transporting.

2. The method defined in claim 1 wherein said substrate is an automotive body part.

3. The method defined in claim 2, further comprising the step of affixing a decorative component to said substrate over a boundary region between said first surface portion and said second surface portion.

* * * * *